US007850107B2

(12) United States Patent
Schafer

(10) Patent No.: US 7,850,107 B2
(45) Date of Patent: Dec. 14, 2010

(54) ROTOR FOR TREE MULCHING MACHINE

(75) Inventor: William C. Schafer, Hector, MN (US)

(73) Assignee: Loftness Specialized Equipment, Inc., Hector, MN (US)

( * ) Notice: Subject to any disclaimer, the term of this patent is extended or adjusted under 35 U.S.C. 154(b) by 102 days.

(21) Appl. No.: 12/334,824

(22) Filed: Dec. 15, 2008

(65) Prior Publication Data

US 2010/0147984 A1 Jun. 17, 2010

(51) Int. Cl.
*B02C 19/00* (2006.01)

(52) U.S. Cl. ..... 241/189.1; 241/194; 241/195

(58) Field of Classification Search ..... 241/189.1, 241/194, 195

See application file for complete search history.

(56) References Cited

U.S. PATENT DOCUMENTS 3,295,302 A * 1/1967 Lee ..... 56/364
3,482,788 A * 12/1969 Newell ..... 241/69
3,547,358 A * 12/1970 Anderson et al. ..... 241/44
4,905,460 A * 3/1990 Toman ..... 56/12.7
5,240,190 A * 8/1993 Johnson ..... 241/74
5,314,126 A * 5/1994 Alvarez ..... 241/189.1
6,227,469 B1 * 5/2001 Daniels et al. ..... 241/186.3
6,871,485 B2 3/2005 Schafer
2001/0008259 A1 * 7/2001 Hruska ..... 241/189.1

OTHER PUBLICATIONS

Gyro-Trac U.S.A. TOMA-AX model literature (Litho/Canada 0900.
Gyro Trac U.S., TOMA-AX model 500M literature (Jun. 2001).
Seppi Inc. "Forestry Mulching Mowers" literature.
FAE USA, Inc. UML/EX—FML/Ex; UML/SSL—FML/SSL; UMM/EX-FMM/EX mulcher literature.

* cited by examiner

*Primary Examiner*—Faye Francis
(74) *Attorney, Agent, or Firm*—Thomas J. Nikolai; Nikolai & Mersereau, P.A.

(57) ABSTRACT

A rotor assembly for a tree cutting attachment for a skid loader. The rotor assembly is made up of a central driven shaft journaled for rotation in the frame of the tree cutting attachment. Circular endplates are disposed proximately on the opposed ends of the central driven shaft. Two diametrically opposed rows of regularly spaced-apart semicircular support plates extend between the circular end plates. The semicircular support plates are held in parallel-spaced relationship by a plurality of equally circumferentially spaced bars extending between the endplates. Swinging hammers are mounted for free pivotal movement in an alternating pattern between the support plates. Each hammer includes a main shaft extending between the support plates, a body member pivotally connected to the main shaft at the pivot axis parallel to and spaced from the central driven shaft and a generally flat tooth member extending radially outward from the body member.

7 Claims, 4 Drawing Sheets

ROTOR FOR TREE MULCHING MACHINE

BACKGROUND OF THE INVENTION

I. Field of the Invention

This invention relates generally to a rotor assembly for a tree mulching machine attachable to a skid loader, tractor or other work vehicle and more particularly to a rotor assembly for such tree mulching machine having a plurality of swinging hammers for downing and pulverizing trees.

II. Discussion of the Prior Art

Cutting machines have been used to clear brush and trees. It is important that these cutting machines work in an efficient and effective manner to assist land-clearing workers in their jobs. To this end, U.S. Pat. No. 6,871,485 is an important step forward for tree cutting machines. The '485 patent teaches a tree cutting attachment for a skid loader or other types of self-propelled work vehicles. The attachment is used to cut down brush and trees of tip to eight to ten inches in diameter. The attachment is made up of a motor-driven rotor assembly which is journaled within the frame of the attachment. The rotor assembly of the '485 patent comprises a cage-like mounting system having pockets in which tempered steel blades, approximately six inches in width, are bolted in side-by-side relationship. Two rows of blades are mounted 180° apart proximate the periphery of the rotor comprised of a series of parallel, generally circular plates that are welded to longitudinally extending rods. The knife blade elements are bolted to the blade holder with the non-sharpened end of the blade element abutting a flat steel bar that forms the part of the cage.

While the invention disclosed in the '485 patent is good for clearing brush and trees of a certain diameter over a certain terrain, there is proven to be a need for a tree cutting machine that is useful over a rougher terrain. For example, a terrain that has partially buried stumps and boulders may present problems for the prior art assemblies which use knife blades or fixed carbide teeth to cut. As an alternative, some have proposed using swinging hammer assemblies to cut the brush. For example, FAE USA, Inc. and Seppi, Inc. have developed a rotor assembly for their work vehicles which may be equipped with swinging hammers. Of course, wear and tear on the hammer is inevitable and therefore must eventually be replaced. The problem presented with the FAE and Seppi assembly is that the entire shalt of hammers must be pulled out of the machine in order to replace a single hammer. A further problem with the FAE assembly is that the entire shaft may need to be cut in order to remove it from the frame if the shaft itself is damaged. This takes the excavator out of operation for an unnecessarily long period of time.

Another commercially available mulching head includes the GyroTrac U.S.A. Inc. TOMA-AX model. The TOMA-AX also uses a swing tooth design with an individual tooth-mounting system combined with a spiral mounting pattern. The swinging teeth are protrusions on the drum of the rotor assembly. These protrusions on the drum cause the drum to jump when engaging a stump, boulder or the like. This reduces both the effectiveness and efficiency of the brush clearing machine and introduces shock loads to the entire machine that tend to shorten the life of the machine.

Therefore, there is a need in the prior art for a rotor assembly for a tree cutting machine which effectively allows for easy and efficient tree and brush clearing with an improved rotary cutting design over past inventions. The rotor cutting design must allow for individual replacement of swinging hammers, but such hammers must not protrude so as to cause the apparatus to jump when it engages a heavy object such as a partially buried stump or boulder.

SUMMARY OF THE INVENTION

The present invention provides an improved rotor assembly for a tree mulching machine. The tree mulching machine is an attachment for use with a skid loader or other such self-propelled work vehicles. The tree mulching machine provides a motor for driving the improved rotor assembly. The rotor assembly includes a central driven shaft journaled for rotation in the frame of the tree mulching machine. Circular end plates are disposed proximate the opposed ends of the central driven shaft. Disposed in between the end plates are two diametrically opposed rows of regularly spaced-apart, semicircular, support plates. A plurality of pockets are formed between adjacent plates. The support plates are held in parallel-spaced relation by a plurality of equally circumferentially spaced bars extending between the end plates. A plurality of swinging hammers are mounted in the pockets in an alternating pattern between adjacent support plates. Each hammer includes a main shaft extending between the support plates, a body member pivotally connected to the main shalt, a pivot axis parallel to the central driven shaft and a generally flat tooth member extending radially outward from the body member and that under centrifugal forces, project radially out beyond the periphery of the support plates. These and other objects, features and advantages of the present invention will become readily apparent to those of skill in the art with the review of the following detailed description in conjunction with the claims and accompanying drawings in which the like numerals in several views refer to the same corresponding parts.

DESCRIPTION OF THE PREFERRED EMBODIMENT

Figure 1:
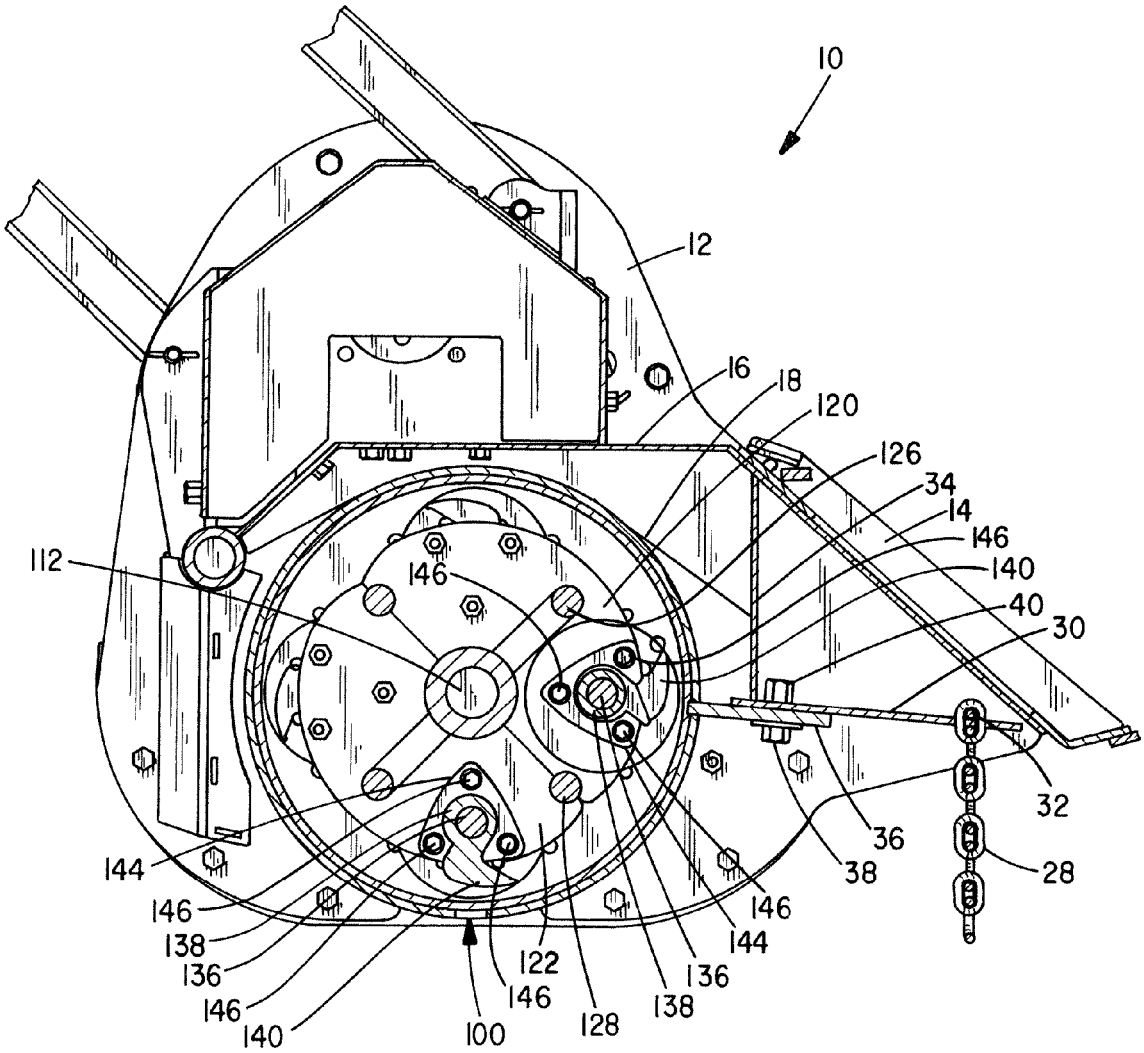
FIG. 1 is a partial cross-sectional view of the tree mulching attachment.

Certain terminology will be used in the following description for convenience in reference only and will not be limiting. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. Said terminology will include the words above specifically mentioned, derivatives thereof and words of similar import.

Referring first to FIG. 1, there is shown a cross-sectional view of a tree mulching attachment similar in some respects to the one disclosed in the '485 patent. The present invention is an improvement for the rotor assembly for such a tree mulching attachment. The tree mulching attachment is, itself, generally indicated by the numeral 10 and includes a housing or shroud 12. A universal mount 14 is adapted to engage with the arms of a skid loader or other work vehicle. The rotor assembly is indicated generally by numeral 100 and is journaled for rotation in bearings in the shroud 12. The shroud 12 further includes housing top 16 and body rib 18. Positioned adjacent the perimeter of the rotor assembly 100 is an adjustable cutter plate 36, the use of which is optional. The adjustable cutter plate 36 acts as an anvil and controls the depth of the cut and size of the wood chips produced as the rotor assembly 100 is driven. A bolt 40 passes through a slotted aperture in the cutter mount 30 and the cutter plate 36 to hold the cutter plate in place. Setting the cutter plate 36 to a minimum hammer clearance reduces feed rate, particle size and horsepower required. Setting the cutter plate 36 to the maximum knife clearance increases the feed rate, particle size and horsepower required. Such a cutter plate can be used with the rotors using either fixed or swinging cutter members.

In FIG. 1, the trees and brush are made to enter the assembly from the left side and are shaved down as they move to the right. The panel projecting out from the front of the assembly serves as a brush deflector 32 to the shaved chips. A plurality of short, closely-spaced individual lengths of chain 28 hang down in a line from the brush deflector 32. The brush deflector and the hanging chains serve to stop chips from flying out of the device at high velocity when in operation.

Figure 2:
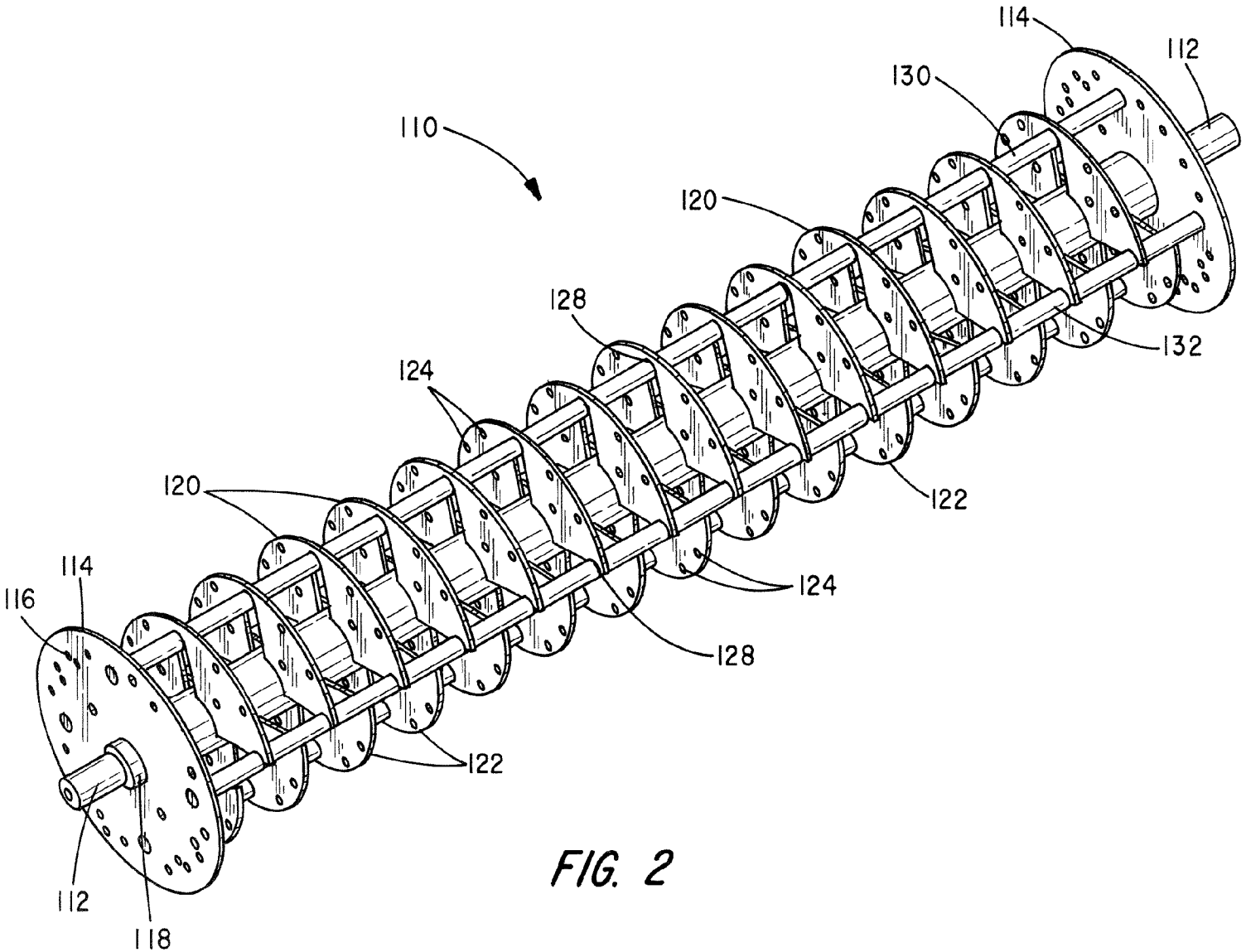
FIG. 2 is a perspective view of the rotor assembly of the present invention but with the swing hammers missing to better show the support plate arrangement.

Referring next to FIG. 2, there is shown a perspective view of the rotor attachment for the tree mulching machine of the present invention. The rotor assembly is generally indicated by the numeral 110. The assembly includes a central driven shaft 112, first and second end plates 14 and a plurality of rows of semicircular plates 120 and 122. The rotor assembly 110 is placed in a housing of a tree mulching machine as shown in FIG. 1 and is mounted to rotate within the machine. A motor drives the central driven shaft 112. This central driven shaft 112 is journaled by bearings (not shown) affixed to a frame member. Each end plate 114 is preferably generally circular and includes a grouping of holes 116 around the outside perimeter of the end plate 114 for attachment of swinging hammers 134 seen in the enlarged partial perspective view of FIG. 3. Each plate also includes a center hole 118 to enable the rotor shaft 112 to extend through and be supported by the end plates 114.

Along the length of the shaft 112 is a plurality of regularly spaced-apart arcuate (semicircular) support plates 120 and 122. There are at least two diametrically opposed rows of the arcuate support plates 120 and 122. These support plates are axially spaced on the shaft 112 and provide the assembly with a caged, generally cylinder-like shape. Around the periphery of each arcuate support plate are a grouping of apertures 124. Furthermore, each support plate has grooves 126 and 128. The support plates 120 and 122 are held in parallel-spaced relation by a plurality of equally circumferentially spaced bars 130, 131, 132, 133 extending between the end plates 114. Thus, when the central shaft 112 is journaled, it carries the end plates 114 and support plates 10 and 122.

Figure 3:
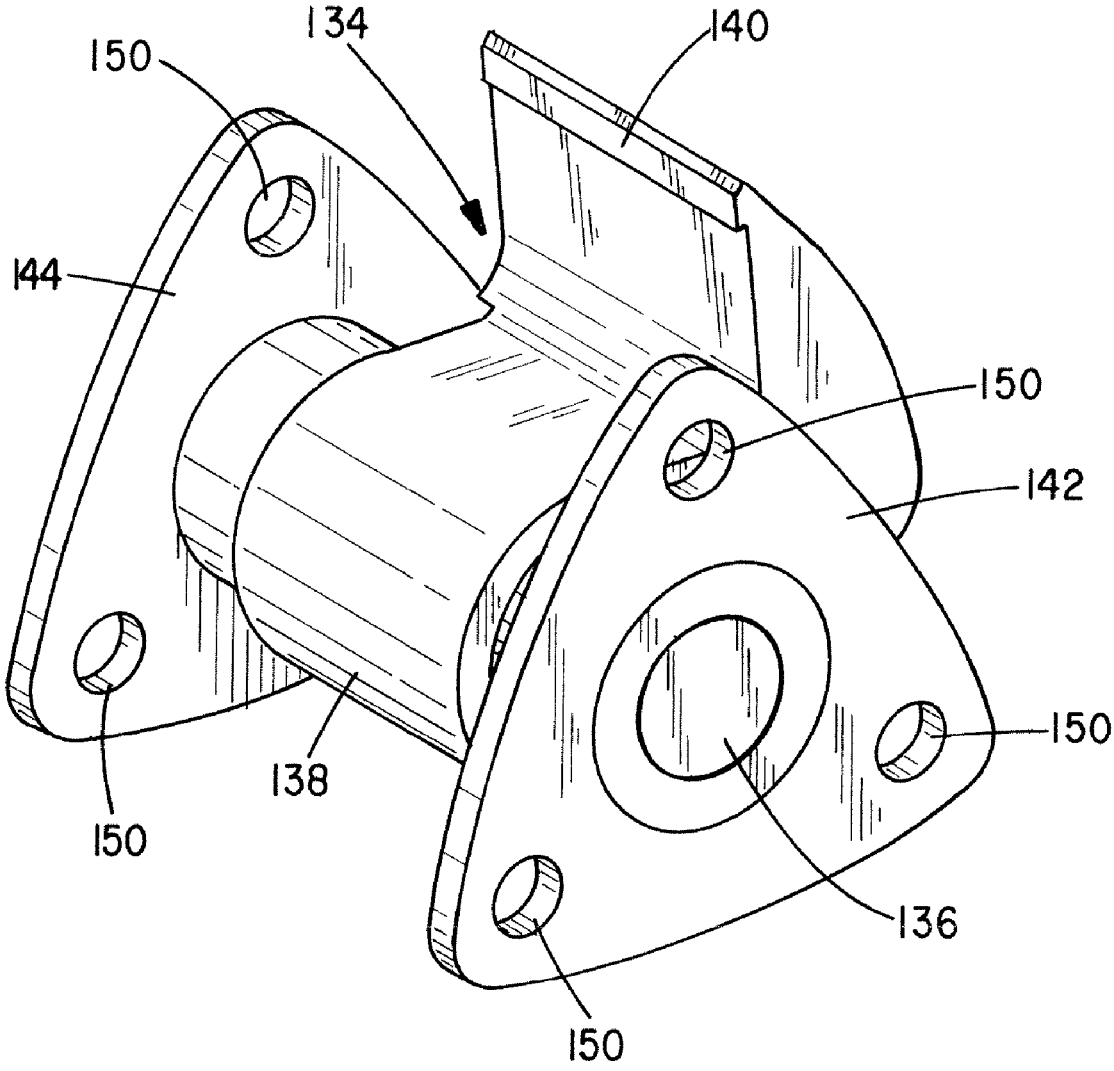
FIG. 3 is a perspective view of the swinging hammer assembly employed in the preferred embodiment of the present invention.
Figure 4:
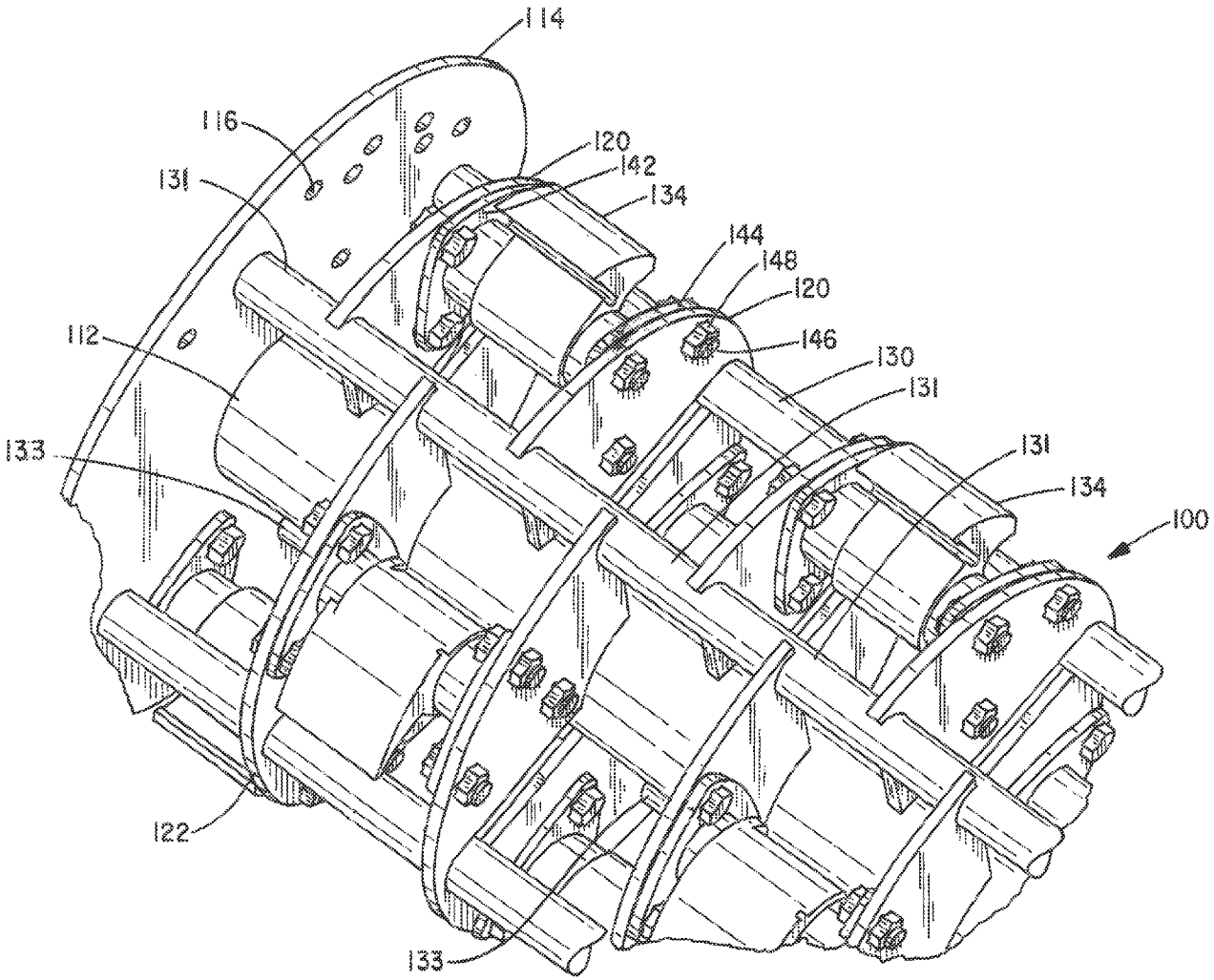
FIG. 4 is a perspective view of the rotor assembly with the swinging hammers in place.

FIG. 3 shows a perspective view of one of the swinging hammer sub-assemblies used with the rotor assembly of the present invention. The swinging hammers 134 each include a main shaft 136 and a body member 138 pivotally mounted to the main shaft at a pivot axis which is oriented parallel to and spaced from the central drive shaft 112 when the hammer assemblies are assembled onto the rotor of FIG. 1. The hammers 134 also include a flat tooth member, as at 140, which is formed integral with the body member 138. The hammer 134 is free to pivot about the main shaft 136. As shown in FIG. 4, the main shaft 136 extends between side flanges 142, 144 disposed on either end of the main shaft 136. The side flanges 142, 144 each have a plurality of fastener apertures 150. Each swinging hammer unit 134 is secured between two adjacent support plates 120 or 122, by coupling the side flanges 142 to the support plates 120 or 122 by bolts 146 passing through the fastener aperture 150 in the side flanges 142, 144 and apertures 124 in the side plates and then secured by nut members 148.

FIG. 4 shows an enlarged close-up view of one end portion of the rotor assembly 100. As seen in this view, there is a plurality of rows of swinging hammers 134 disposed around the circumference of the rotor assembly 100. Each row is disposed between the spaced bars 130, 132, 131 and 133. Within each row, the swinging hammers 134 alternate pockets between support plates 120 and 122 so that no two hammers 134 are directly next to one another within a row. Furthermore, the rows partially overlap one another so that the row between spaced bars 130 and 131 overlaps the row of hammers between spaced bars 131 and 132.

In operation, when the central driven shaft 112 is driven by a hydraulic motor (not shown), the rotor assembly 100 rotates in a counterclockwise direction when viewed as in FIG. 1, centrifugal force causes the swing hammers to rotate counterclockwise about their shafts 136, such that the teeth 140 extend radially beyond the periphery of the support plates 120, 122. The rotor may also be configured to rotate clockwise, if required to present the knife edge of the hammers to the tree being cut and mulched. When the hammers 134 strike the brush and small trees to be cleared, they cut the brush. However, if the rotor assembly 100 comes in contact with a stump or boulder, the hammers 134 will swing clockwise tucking the hammer away between the support plates 120 or 122 and leave no protrusion outside the orbit circle formed by the support plates 120 and 122. This substantially reduces the wear and tear on the rotor assembly 100 and avoids impact and shock loads on the entire machine and resulting in self-destruction.

In the event hammers become worn down or otherwise damaged, they can be removed individually by removing the fasteners securing the side flanges 140 and 144 to the support plates 120 and 122 and there is no need to completely disassemble the rotor as in prior art designs.

This invention has been defined herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A rotor assembly for a tree mulching machine having a frame adapted to be coupled to a work vehicle, the rotor assembly comprising:

a) a central driven shaft journaled for rotation in said frame;

b) circular end plates disposed proximate opposed ends of said central driven shaft;

c) first and second diametrically opposed rows of regularly spaced-apart, generally semicircular, arcuate support plates held in parallel spaced relation, the support plates in the first row being laterally offset to fall between the support plates in the second row; and d) a plurality of swing hammers mounted for free pivotal movement in a staggered pattern between said support plates in said first and second rows, each swing hammer including a main shaft extending between adjacent pairs of side flanges individually removably attached to an adjacent pair of support plates, a body member pivotally connected to the main shaft about a pivot axis oriented parallel to and spaced from the central driven shaft, and the body member having a generally flat tooth portion extending radially outward therefrom.

2. The rotor assembly as in claim 1 wherein the plurality of swing hammers travel in a direction such that said flat tooth portion is generally tangent to a periphery of the rotor assembly.

3. The rotor assembly as in claim 1 wherein the main shaft of each swing hammer further includes said side flanges for coupling the main shaft of each swing hammer to support plates disposed on either side of the main shaft for that swing hammer.

4. The rotor assembly as in claim 1 wherein the tooth portion is rotatable about the pivot axis.

5. The rotor assembly as in claim 1 wherein the tooth member is disposed forward toward a direction of rotation from a line defined by the center of gravity of the hammer and the pivot axis.

6. The rotor assembly as in claim 1 wherein rotation of the central driven shaft applied\s a centrifugal force on the swing hammers to cause the flat tooth portion to protrude beyond the periphery of the support plates.

7. The rotor assembly as in claim 1 wherein the support plates are held in parallel, spaced relation by a plurality of circumferentially spaced bars that extend between the end plates.

* * * * *